US008842302B2

(12) United States Patent
Kamata

(10) Patent No.: US 8,842,302 B2
(45) Date of Patent: Sep. 23, 2014

(54) IMAGE FORMING APPARATUS FOR DETERMINING PAPER EJECTION ORDER OF STACKERS

(75) Inventor: Yoshihisa Kamata, Hadano (JP)

(73) Assignee: Konica Minolta, Inc., Tokyo (JP)

( * ) Notice: Subject to any disclaimer, the term of this patent is extended or adjusted under 35 U.S.C. 154(b) by 57 days.

(21) Appl. No.: 13/586,613

(22) Filed: Aug. 15, 2012

(65) Prior Publication Data

US 2013/0070272 A1 Mar. 21, 2013

(30) Foreign Application Priority Data

Sep. 16, 2011 (JP) ..... 2011-202716

(51) Int. Cl.

| | |
|---|---|
| ***G06K 15/02*** | (2006.01) |
| ***B65H 31/24*** | (2006.01) |
| ***G03G 15/00*** | (2006.01) |
| ***B41J 13/10*** | (2006.01) |

(52) U.S. Cl.

CPC ..... *B65H 31/24* (2013.01); *G03G 15/6538* (2013.01); *B41J 13/106* (2013.01); *B65H 2405/15* (2013.01); *B65H 2301/42252* (2013.01)

USPC ..... 358/1.13; 358/1.15; 271/297; 271/298

(58) Field of Classification Search

CPC ..... B65H 31/24; B65H 29/60; G03G 15/00; G03G 21/00

USPC ..... 358/1.13–1.15; 271/297, 298

See application file for complete search history.

(56) References Cited

U.S. PATENT DOCUMENTS

| | | | | |
|---|---|---|---|---|
| 2006/0157926 | A1* | 7/2006 | Sato et al. | 271/298 |
| 2008/0154426 | A1* | 6/2008 | Kikuchi | 700/219 |

FOREIGN PATENT DOCUMENTS

| | | |
|---|---|---|
| JP | 2004-259219 | 9/2004 |
| JP | 2005-292442 | 10/2005 |
| JP | 2008-221800 | 9/2008 |
| JP | 2008-276120 | 11/2008 |

OTHER PUBLICATIONS

Machine translation for JP 2005-292442, IDS.*

Office Action mailed Oct. 8, 2013 in Japanese Priority Application No. 2011-202716.

* cited by examiner

*Primary Examiner* — Qian Yang

(74) *Attorney, Agent, or Firm* — Holtz Holtz Goodman & Chick PC

(57) ABSTRACT

An image forming apparatus including an image forming unit which continuously forms an image on sheets of paper, three or more stackers to which the sheets on which the image is formed by the image forming unit are ejected and a control unit which determines paper ejection order of stackers to which the sheets are to be ejected among the three or more stackers in a predetermined order, wherein each of the stackers includes a loading unit on which the sheets are loaded and a conveyance cart which is disposed under the loading unit and by which the loading unit can be removed from the stacker.

12 Claims, 15 Drawing Sheets

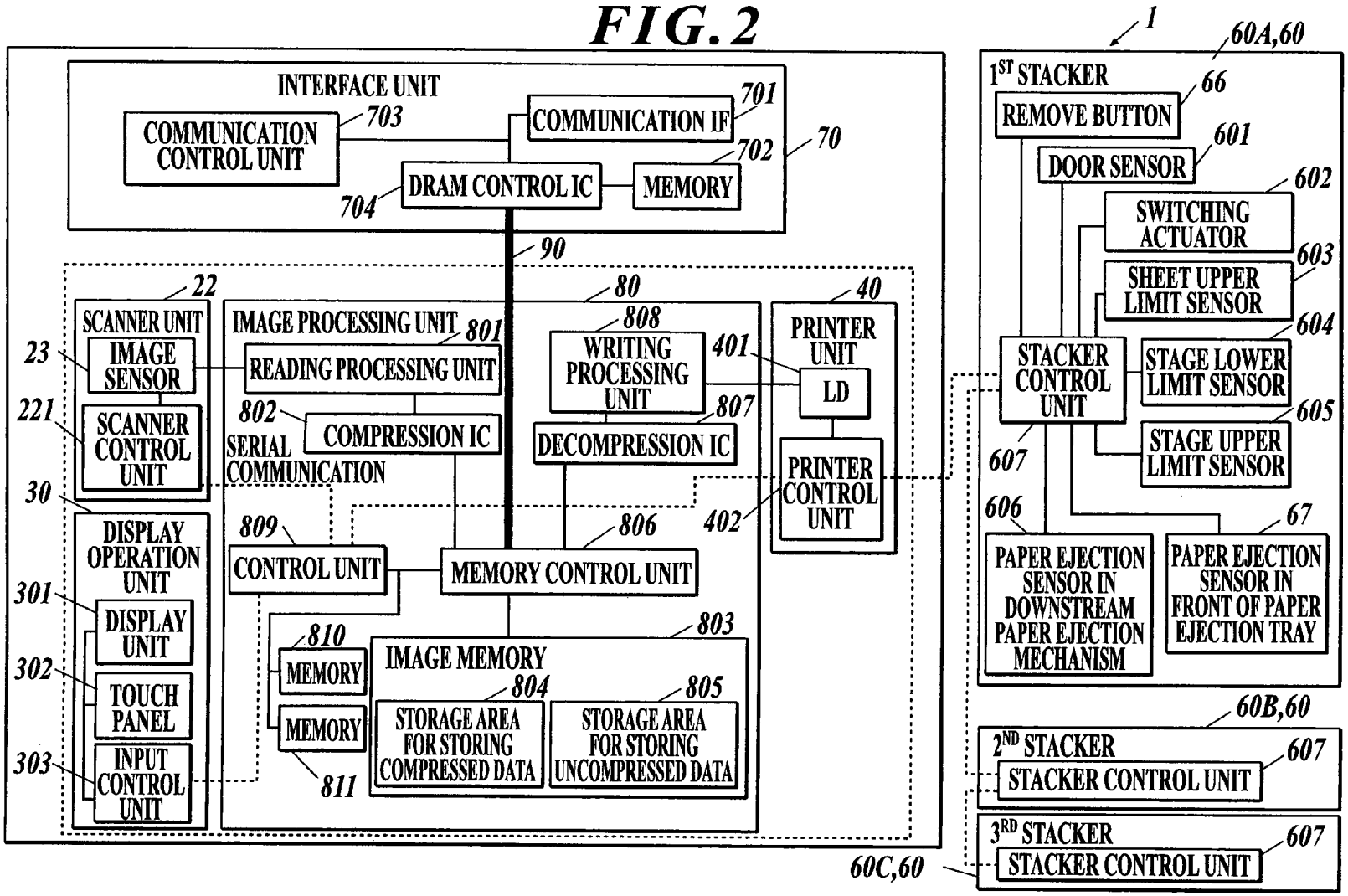
FIG. 2
1
60A,60
1ST STACKER
66
REMOVE BUTTON
601
DOOR SENSOR
602
SWITCHING ACTUATOR
603
SHEET UPPER LIMIT SENSOR
604
STAGE LOWER LIMIT SENSOR
605
STAGE UPPER LIMIT SENSOR
67
PAPER EJECTION SENSOR IN FRONT OF PAPER EJECTION TRAY
STACKER CONTROL UNIT
607
606
PAPER EJECTION SENSOR IN DOWNSTREAM PAPER EJECTION MECHANISM
60B,60
2ND STACKER
STACKER CONTROL UNIT
607
3RD STACKER
STACKER CONTROL UNIT
607
60C,60
INTERFACE UNIT
70
COMMUNICATION IF
701
MEMORY
702
DRAM CONTROL IC
704
COMMUNICATION CONTROL UNIT
703
90
80
PRINTER UNIT
40
LD
401
PRINTER CONTROL UNIT
402
WRITING PROCESSING UNIT
808
DECOMPRESSION IC
807
MEMORY CONTROL UNIT
806
IMAGE MEMORY
803
STORAGE AREA FOR STORING UNCOMPRESSED DATA
805
STORAGE AREA FOR STORING COMPRESSED DATA
804
IMAGE PROCESSING UNIT
801
READING PROCESSING UNIT
COMPRESSION IC
802
SERIAL COMMUNICATION
CONTROL UNIT
809
MEMORY
810
MEMORY
811
SCANNER UNIT
22
IMAGE SENSOR
23
SCANNER CONTROL UNIT
221
DISPLAY OPERATION UNIT
30
DISPLAY UNIT
301
TOUCH PANEL
302
INPUT CONTROL UNIT
303

STATE WHERE THERE IS NO SHEET IN STACKER

STATE 1 WHERE THERE ARE SHEETS IN STACKER

STATE 2 WHERE THERE ARE SHEETS IN STACKER

STATE WHERE THERE ARE SHEETS IN STACKER AND STAGE IS LOWERED

STATE WHERE THERE IS NO SHEET IN STACKER AND STAGE IS LOWERED
60
61
62
63a
64
65
68
68A
68B

FIG.8

| |
|---|
| 1ST STACKER |
| J1 |
| J2 |
| 2ND STACKER |
| J1 |
| J2 |
| 3RD STACKER |
| J1 |
| J2 |

FIG.9

| |
|---|
| 1ST STACKER |
| J1 1(SET STATE) |
| J2 2(PRIORITY ORDER 2) |
| 2ND STACKER |
| J1 1(SET STATE) |
| J2 3(PRIORITY ORDER 3) |
| 3RD STACKER |
| J1 1(SET STATE) |
| J2 1(PRIORITY ORDER 1) |

1ST STACKER (REMOVE) →

| |
|---|
| 1ST STACKER |
| J1 0(NON-SET STATE) |
| J2 0(NOT SPECIFIED) |
| 2ND STACKER |
| J1 1(SET STATE) |
| J2 2(PRIORITY ORDER 2) |
| 3RD STACKER |
| J1 1(SET STATE) |
| J2 1(PRIORITY ORDER 1) |

IMAGE FORMING APPARATUS FOR DETERMINING PAPER EJECTION ORDER OF STACKERS

BACKGROUND OF THE INVENTION

1. Field of the Invention

The present invention relates to an image forming apparatus.

2. Description of Related Art

Conventionally, as an image forming apparatus which is able to perform image formation of a large number of copies, there is known an image forming apparatus which includes a plurality of large-capacity stackers. In the image forming apparatus, sheets of paper after image formation are ejected to a stacker so as to be stacked therein, and when the stacker becomes full of the sheets, the stacked sheets are removed by a conveyance cart which is removable from the stacker. Because the stacker is closed with a door, the stacker is configured so that sheets inside the stacker are difficult to be checked visually.

In such an image forming apparatus which includes a plurality of stackers as places for ejecting sheets, there is suggested a technique which makes it easier to perform operation such as bookbinding after image formation by ejecting sheets according to each image forming job or each set of copies to a same stacker (see Japanese Patent Application Laid Open Publication No. 2005-292442).

Incidentally, generally, a priority order of stackers is set in the image forming apparatus which includes a plurality of stackers. However, there has been a problem that it is difficult to recognize to which stacker sheets will be ejected next when one stacker becomes full of sheets because even a stacker which has a higher priority is skipped if a conveyance cart is not set therein when sheets are to be ejected and sheets are ejected to a stacker which comes next in the priority order.

SUMMARY OF THE INVENTION

The present invention was made in consideration of the above problem in the conventional technique, and an object of the present invention is to make it possible to easily recognize a stacker to which sheets will be ejected next in an image forming apparatus which includes three or more stackers.

In order to achieve the above object, according to one aspect of the present invention, an image forming apparatus includes an image forming unit which continuously forms an image on sheets of paper, three or more stackers to which the sheets on which the image is formed by the image forming unit are ejected and a control unit which determines paper ejection order of stackers to which the sheets are to be ejected among the three or more stackers in a predetermined order, wherein each of the stackers includes a loading unit on which the sheets are loaded and a conveyance cart which is disposed under the loading unit and by which the loading unit can be removed from the stacker.

Preferably, in the image forming apparatus, the stackers to which the sheets are to be ejected are stackers other than a stacker in a state where the conveyance cart is removed.

Preferably, in the image forming apparatus, the stackers to which the sheets are to be ejected are stackers other than a stacker in a full state where the sheets are fully loaded on the loading unit.

Preferably, in the image forming apparatus, the predetermined order is an order in which the conveyance carts are set.

Preferably, in the image forming apparatus, the control unit determines the paper ejection order in an order based on setting change operation when a user performs the setting change operation to set the paper ejection order.

Preferably, the image forming apparatus further includes a display unit which displays the paper ejection order.

Preferably, in the image forming apparatus, the display unit displays which state among full, ejecting paper and ready for paper ejection each of the stackers is in.

Preferably, in the image forming apparatus, the control unit determines the paper ejection order of the stackers to be an ascending order of distance from the image forming unit immediately after the image forming apparatus is turned on, a stacker in a state where the conveyance cart is removed and a stacker in a full state where the sheets are fully loaded on the loading unit being excluded.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 2 is a block diagram showing a control structure of the image forming apparatus of FIG. 1;

FIG. 8 is a diagram for explaining a configuration of state information and paper ejection order information of each stacker;

FIG. 9 is a diagram for explaining rewrite of the state information and paper ejection order information;

DETAILED DESCRIPTION OF THE PREFERRED EMBODIMENT

Hereinafter, an embodiment of the present invention will be described with reference to the drawings. However, the scope of the invention is not limited to the illustrated examples.

Figure 1:
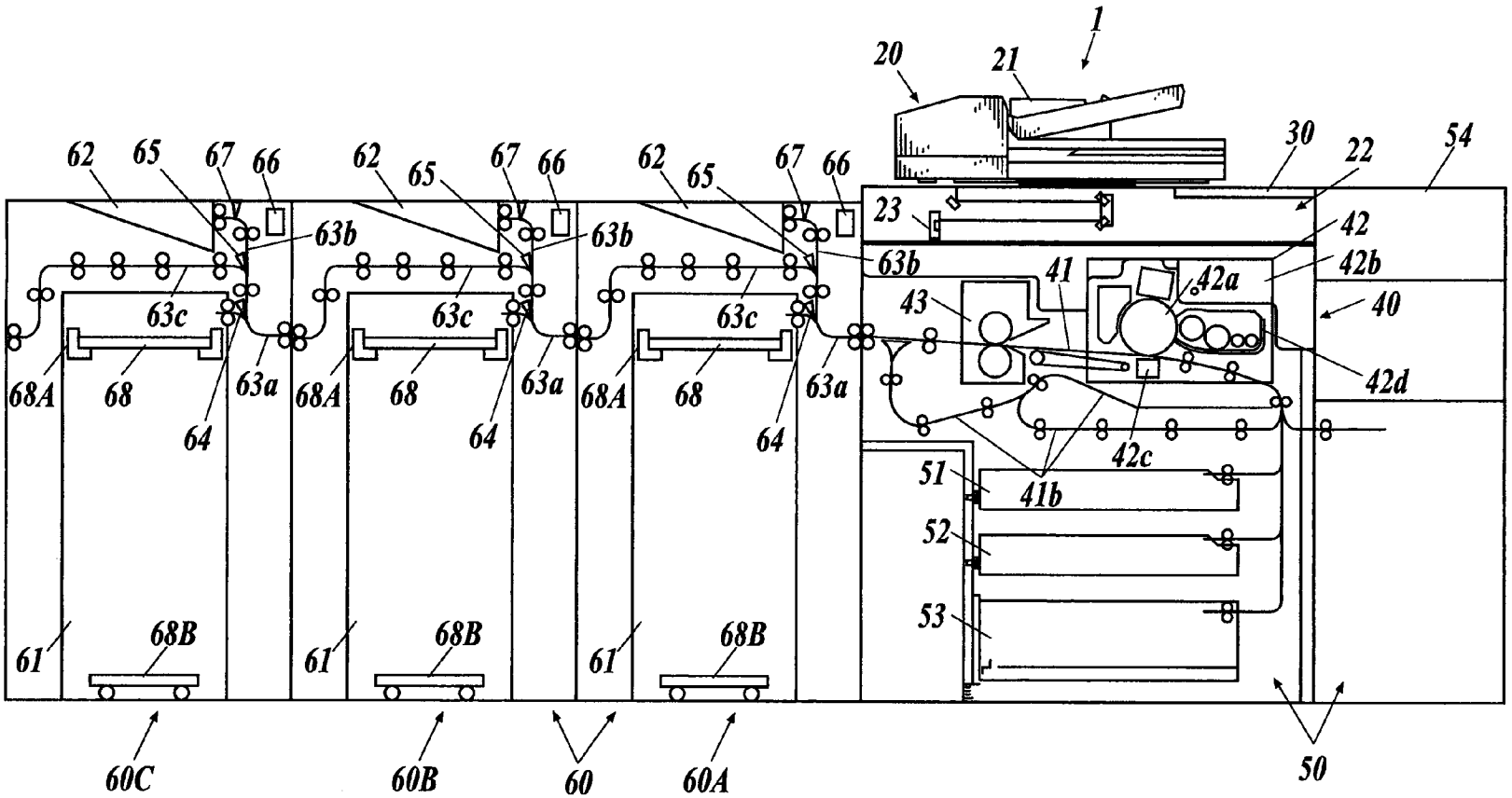
FIG. 1 is an overall configuration view of an image forming apparatus of an embodiment of the present invention.

FIG. 1 is an overall configuration view of an image forming apparatus in the embodiment of the present invention and FIG. 2 is a block diagram of a control structure of the image forming apparatus in the embodiment of the present invention.

The image forming apparatus 1 in the embodiment is an apparatus which continuously performs image formation of a plurality of copies and continuously ejects sheets of paper on which images are formed. The image forming apparatus 1 is configured so that the number of copies of image formation, image content of each page, type of sheets, the side to form an image on (such as single side or double side) and such like can be input to be set as an image forming job (hereinafter called job), and after the jobs are input to be set, image formation according to the jobs is to be continuously executed by instructing the execution of the jobs.

As shown in FIGS. 1 and 2, the image forming apparatus 1 includes an image reading unit 20 for reading content of an image to be formed, a display operation unit 30 for performing display for operations and inputs of operation commands from a user, a printer unit 40 for forming images on sheets of paper, a paper feeding mechanism 50 which is able to feed a plurality of types of paper, a paper ejection mechanism 60 which ejects sheets on which images are formed, an interface unit 70 for receiving image data for image formation from an external terminal and an image processing unit 80 which stores and reads out the image data for image formation.

The image reading unit 20 includes a scanner unit 22 which scans a document placed on a platen glass by an image sensor 23 such as CCD (Charge Coupled Device) to change the document image into data format, an automatic paper feeding mechanism (ADF: Auto Document Feeder) 21 which feeds a plurality of documents so that the documents can be continuously read by the scanner unit 22, and such like. In addition to the image sensor 23, the scanner unit 22 is also provided with a scanner control unit 221 which performs control processing with respect to image reading.

The display operation unit 30 includes various types of function keys such as number buttons, a start key to instruct a start of image formation and utility keys. The display operation unit 30 receives input from a user and outputs the input information to a control unit 809 (after-mentioned).

The display operation unit 30 includes a display unit 301 such as a liquid crystal panel, a touch panel 302 disposed on the display unit 301 and an input control unit 303 which performs display control of the display unit 301, signal input processing of signals input from the touch panel 302, and such like. On the display unit 301, various types of operation screens such as a setting screen of setting conditions and various types of processing results are displayed.

The printer unit 40, for example, performs electrographic image formation and includes an image forming unit 42 which transfers a toner image based on image data onto a sheet of paper, a fixing unit 43 which fixes the toner image, a conveyance path 41 which conveys a fed sheet to the image forming unit 42, a conveyance path 41*b* for double-sided processing which reverses a sheet on one side of which an image is formed and feeds the sheet to the image forming unit 42 again, and such like.

The image forming unit 42 includes a photosensitive drum 42*a* on the surface of which image patterns are formed by exposure, a laser unit 42*b* which performs exposure scanning on the surface of the photosensitive drum 42*a* based on the image data, a transfer device 42*c* which transfers the toner onto the sheets, a developing device 42*d* which supplies toner to the surface of the photosensitive drum 42*a*, and such like. The image forming unit 42 is configured so that toner is transferred onto the sheets in the image which is formed on the photosensitive drum 42*a* by passing the sheets between the photosensitive drum 42*a* and the transfer device 42*c*.

In addition, the printer unit 40 includes a laser diode (LD) 401 of the laser unit 42*b* which performs the exposure processing, and a printer control unit 402 which performs control processing with respect to image forming processing.

The paper feeding mechanism 50, for example, includes a plurality of paper feeding trays 51 to 53 each of which contains a different type of sheets in different paper types or sizes and perform paper feeding independently from each other, a paper feeding unit 54 which contains a large number of sheets and performs paper feeding, and such like.

The paper ejection mechanism 60 is configured by connecting three stackers (first stacker, second stacker and third stacker) 60A, 60B and 60C which can contain a large number of sheets on which images are formed. The stackers are called a first stacker 60A, a second stacker 60B and a third stacker 60C in ascending order of distance from the image forming unit 42 (in an order from the nearest to the furthest from the image forming unit 42). In FIG. 2, configurations of each unit in the stacker 60B and the stacker 60C which are the second and third stackers are omitted.

Each of the three stackers 60A, 60B and 60C includes a paper ejection unit 61 which can contain a large number of ejected sheets on which images are formed in a stacked state.

The paper ejection unit 61 includes an elevating member 68A which goes up and down by a driving method (not shown in the drawings) having a motor, belt or wire and such like, a stage (loading unit) 68 which is placed on the elevating member 68A and moves up and down in the paper ejection unit 61, a conveyance cart 68B which is disposed below the stage 68 and by which the stage 68 can be removed from the paper ejection unit 61, a door 61A (see FIG. 4) which is provided on the front side of the paper ejection unit 61 and closes the inside of the paper ejection unit 61, and such like.

Also, each of the three stackers 60A, 60B and 60C includes a paper ejection tray 62 which is exposed outside and to which the sheets on which images are formed are visibly ejected, conveyance paths 63*a* to 63*c* which send the sheets sent from the printer unit 40 to the paper ejection unit 61 or the paper ejection tray 62, switching pieces 64 and 65 which switch the destination for sending the sheets among the conveyance paths 63*a* to 63*c*, a remove button 66 for removing the sheets which are stacked up in the paper ejection unit 61 during the image forming processing, a paper ejection sensor 67 which detects ejection of the sheets to the paper ejection tray 62, a door sensor 601 which detects opening of the door 61A, a switching actuator 602 which independently rotates the switching pieces 64 and 65 to switch the destination for sending the sheets, a sheet upper limit sensor 603 which detects that the sheets stacked on the stage 68 reached the upper limit, a stage lower limit sensor 604 which detects that the stage 68 reached the lower limit position, a stage upper limit sensor 605 which detects that the stage 68 reached the upper limit position, a paper ejection sensor 606 which detects that sheets are ejected to the downstream-side paper ejection mechanism 60, a stacker control unit 607 which integrally controls the processing of the paper ejection mechanism 60, and such like.

In addition, the switching pieces 64 and 65, the switching actuator 602 and the stacker control unit 607 constitute a switching unit, and the switching actuator 602 rotates the switching pieces 64 and 65 by being controlled by the stacker control unit 607 and the switching pieces 64 and 65 block either one of the conveyance paths 63*b* and 63*c* to guide the sheets to the other conveyance path.

In a case where a plurality of stackers are connected as in the embodiment, the stacker control unit 607 of the first stacker 60 (the first stacker 60A) is connected to the printer control unit 402 of the printer unit 40 so as to perform serial communication therebetween so that synchronous control and such like can be performed on processing of the both control units, and the stacker control unit 607 of the second stacker 60 (the second stacker 60B) is connected to the stacker control unit 607 of the first stacker 60A and the stacker control unit 607 of the third stacker 60 (the third stacker 60C) so as to perform serial communication with each stacker control unit 607 so that synchronous control and such like can be performed on processing of each stacker.

Here, functions of the stackers will be explained with reference to FIGS. 3 and 4.

The sheets of paper on which images are formed in the above image forming processing and which are continuously sent to the paper ejection unit 61 of the stacker are processed inside the paper ejection unit 61 as follows.

Figures 3A, 3B, 3C, 3D, 3E:
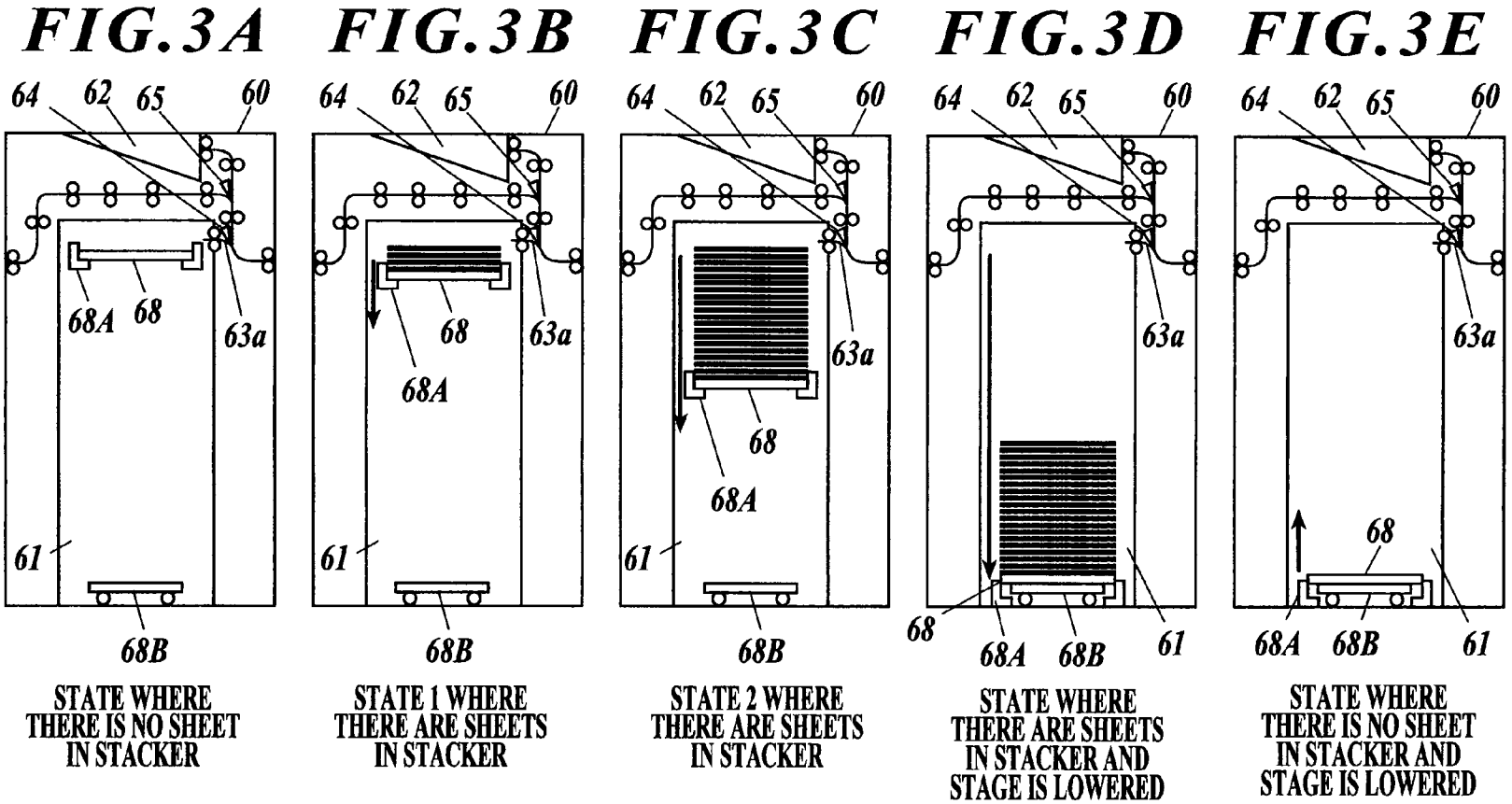
FIG. 3 is a diagram for explaining functions of a stacker.
Figure 4:
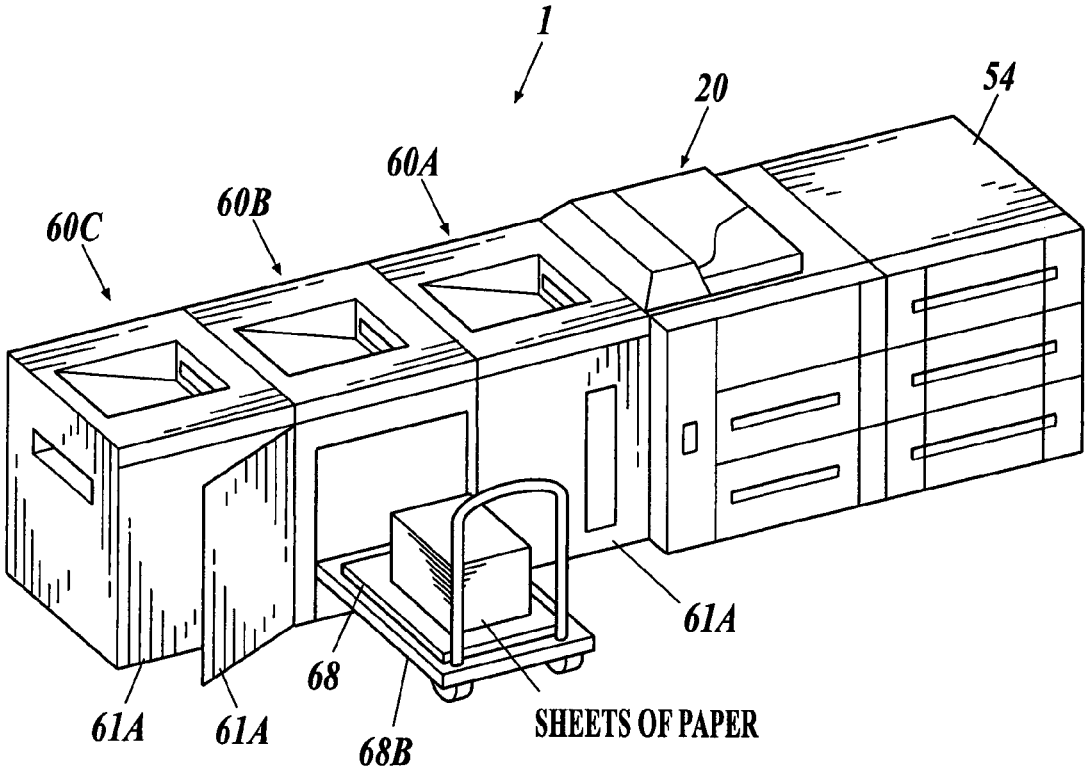
FIG. 4 is a diagram illustrating how sheets of paper are removed from a stacker.

That is, as shown in FIG. 3A, the stage 68 is located at the upper limit position in a state where there is no sheet when image forming processing starts. Here, the door 61A of the paper ejection unit 61 is closed and it is difficult to see the inside of the paper ejection unit 61 from the outside.

When a sheet on which images are formed is sent from the printer unit 40 in such a state, the sheet is conveyed by the conveyance path 63*a* and sent to the inside of the paper ejection unit 61 guided by the switching piece 64. Then, the sheet is stacked on the stage 68. When such processing is repeated and a plurality of sheets are stacked on the stage 68, as shown in FIG. 3B, the elevating member 68A is actuated based on the sensor output from the sheet upper limit sensor 603 and the stage 68 comes down so as to keep the position of the top sheet approximately at a constant position. Then, as shown in FIG. 3C, a large number of sheets on which images are formed are stacked on the stage 68.

When a user wants to remove the sheets on which images are formed from the paper ejection unit 61, the user presses the remove button 66. When the remove button 66 is pressed, as shown in FIG. 3D, the stage 68 which has come down in a state of being placed on the elevating member 68A abuts the upper surface of the conveyance cart 68B and is mounted on the conveyance cart 68B. Because the elevating member 68A comes down further by a driving means and thereby releases the holding of the stage 68 and stops, a user can remove the sheets on which images are formed together with the stage 68 which is mounted on the conveyance cart 68B from the inside of the paper ejection unit 61 by opening the door 61A of the stacker 60 and pulling out the conveyance cart 68B in the above state (see FIG. 4).

Then, as shown in FIG. 3E, after the sheets are removed, when the stage 68 and the conveyance cart 68B are inserted again and the door 61A is closed, the stage 68 is raised by the elevating member 68A again based on the sensor signal of "door closed" as shown in FIG. 3A.

The interface unit 70 is provided with a communication interface (communication IF) 701 which is connected to LAN (Local Area Network) and sends and receives data, a memory 702 which temporarily stores image data received from an external terminal via the communication interface 701, a DRAM (Dynamic Random Access Memory) control IC 704 which reads and writes data from and into the memory 702 and performs input and output of data between the image processing unit 80 via a bus 90, a communication control unit 703 which overall controls the interface unit 70, and such like, for example.

The image processing unit 80 is provided with a reading processing unit 801 which receives read signals sent from the image sensor 23 of the scanner unit 22 and converts the signals to image data, a compression IC 802 which compresses the read image data, an image memory 803 which stores the image data, a storage area 804 for storing the compressed image data which is set for storing the compressed image data among the storage areas in the image memory 803, a storage area 805 for storing uncompressed image data which is set for temporarily storing uncompressed image data sent from an external terminal, a memory control unit 806 which controls reading and writing of data from and into the image memory 803, a decompression IC 807 which decompresses the compressed image data, a writing processing unit 808 which outputs the signals for image formation to the laser diode 401 of the printer unit 40 based on the decompressed image data, a non-volatile memory 810 in which various types of setting data and such like are stored, a non-volatile memory 811 in which setting data regarding the paper ejection mechanism 60 and such like are stored, a control unit 809 which performs serial communication with the scanner control unit 221, the input control unit 303 and the printer control unit 402 which are respectively provided in the scanner unit 22, the display operation unit 30 and the printer unit 40 to perform synthetic control and such like with each unit, and such like.

As processing operations of the image forming apparatus 1 configured as mentioned above, input processing of the image data, image forming processing and paper ejection order determination processing will be explained in this order.

[Input Processing of Image Data]

There are two types of input processing of image data one of which is a method of reading images of the document using the image reading unit 20 and the other of which is a method of sending image data from an external terminal via the interface unit 70.

In the input processing of image data which uses the image reading unit 20, a user sends a document by using the ADF 21 or placing the document on the platen glass to operate the scanner unit 22 first, and thereby, the images of the document are taken in as image signals by the image sensor 23. Then, the image signals are converted to image data in the reading processing unit 801, thereafter compressed in the compression IC 802, and stored in the storage area 804 in the image memory 803 via the memory control unit 806.

In the input processing of image data which uses the interface unit 70, image data sent from an external terminal is received via the communication interface 701 first and is temporarily stored in the memory 702 of the interface unit 70 via the DRAM control IC 704. Then, the image data is transmitted to the storage area 805 in the image memory 803 via the DRAM control IC 704 of the interface unit 70, bus 90 and the memory control unit 806 of the image processing unit 80, and thereafter, the transmitted image data is sent to the compression IC 802 via the memory control unit 806 to be compressed. Then, the compressed image data is stored in the storage area 804 in the image memory 803 via the memory control unit 806 again.

[Image Forming Processing]

Image forming processing for one page is performed as follows. That is, first, image data to be transferred on a sheet of paper is readout from the storage area 804 in the image memory 803 and sent to the decompression IC 807 by the memory control unit 806. Then, the image data is decompressed in the decompression IC 807 and sent to the writing processing unit 808. Image signals are sent to the laser diode 401 in a predetermined timing based on the image data by the writing processing unit 808, laser is output from the laser diode 401 onto the photosensitive drum 42*a* based on the image data, exposure patterns based on the image data are formed on the surface of the photosensitive drum 42*a* and toner is supplied to the photosensitive drum 42*a* from the developing device 42*d*. Also, in parallel with these processing, a sheet is conveyed on the conveying paths 41 and 41*b* by the printer control unit 402 of the printer unit 40 rotating the driving motor (not shown in the drawings) and passes between the photosensitive drum 42*a* on which light is exposed and the transferring device 42*c*. Thereby, a toner image based on the image data is formed on the sheet. Next, the sheet is sent to the fixing unit 43 and the toner attached on the sheet is fixed, and thereafter, the sheet is sent to the paper ejection mechanism 60. Such processing is repeatedly performed for the set number of copies based on the job content which is set in the non-volatile memory 810 and the like.

[Paper Ejection Order Determination Processing]

Paper ejection order determination processing is processing for determining the priority order (paper ejection order) for using the first stacker 60A, the second stacker 60B and the third stacker 60C.

First, immediately after the image forming apparatus 1 is turned on, paper ejection order is determined to be an ascending order of distance from the image forming unit 42 (that is, in an order of the first stacker 60A, the second stacker 60B and then the third stacker 60C) by excluding a stacker in a state where the conveyance cart 68B is removed and a stacker in a full state where the sheets are fully loaded on the stage 68.

Then, the image forming processing proceeds and when the conveyance cart 68B is pulled out from any one of the stackers, when the conveyance cart 68B is set in any one of the stackers or such like, paper ejection order determination processing which determines the priority order for using the three stackers is performed.

Specifically, among the three stackers, stackers other than a stacker in a state where a conveyance cart 68B is removed and a stacker in a full state where sheets are fully loaded on the stage 68 are determined to be stackers to which sheets can be ejected, and paper ejection order is determined for the stackers to which sheets can be ejected in a predetermined order.

As the "predetermined order", specifically, an order in which the conveyance carts 68B are set in the stackers can be referred.

It can be said that when the paper ejection order is determined to be the order in which the conveyance carts 68B are set, a user can recognize the order easily because the order in which the user sets the conveyance carts 68B becomes the paper ejection order of the stackers without any change.

The paper ejection order which was determined by the above paper ejection order determination processing is displayed on the display unit 301 of the display operation unit 30.

Here, a display screen A which is displayed on the display unit 301 while performing the job will be specifically explained with reference to FIGS. 5 and 6.

On the display screen A, a job display area A1, a paper tray display area A2, a stacker state display area A3 and such like are displayed.

In the job display area A1, "NO." indicating the number of each job, "mode" indicating conditions of image formation such as double-sided printing/single-sided printing, "state" indicating a state of progress of each job such as image formation-in-progress/stand-by, "time(minute)" indicating processing time of the job and "user name" indicating a user who requested the job are displayed.

In the paper tray display area A2, "size", "type", "basis weight" and "remaining amount" of each paper stored in the paper feeding trays 51 to 53 are displayed.

The stacker state display area A3 is used for a user to grasp the priority order (paper ejection order) of the first stacker 60A, the second stacker 60B and the third stacker 60C and the state of each stacker.

Specifically, in the stacker state display area A3, a schematic diagram of the image forming apparatus, numbers each of which indicating the paper ejection order of each stacker and schematic diagrams each of which indicating the state (full, ejecting paper, or ready for paper ejection) of each stacker are displayed.

Figure 5:
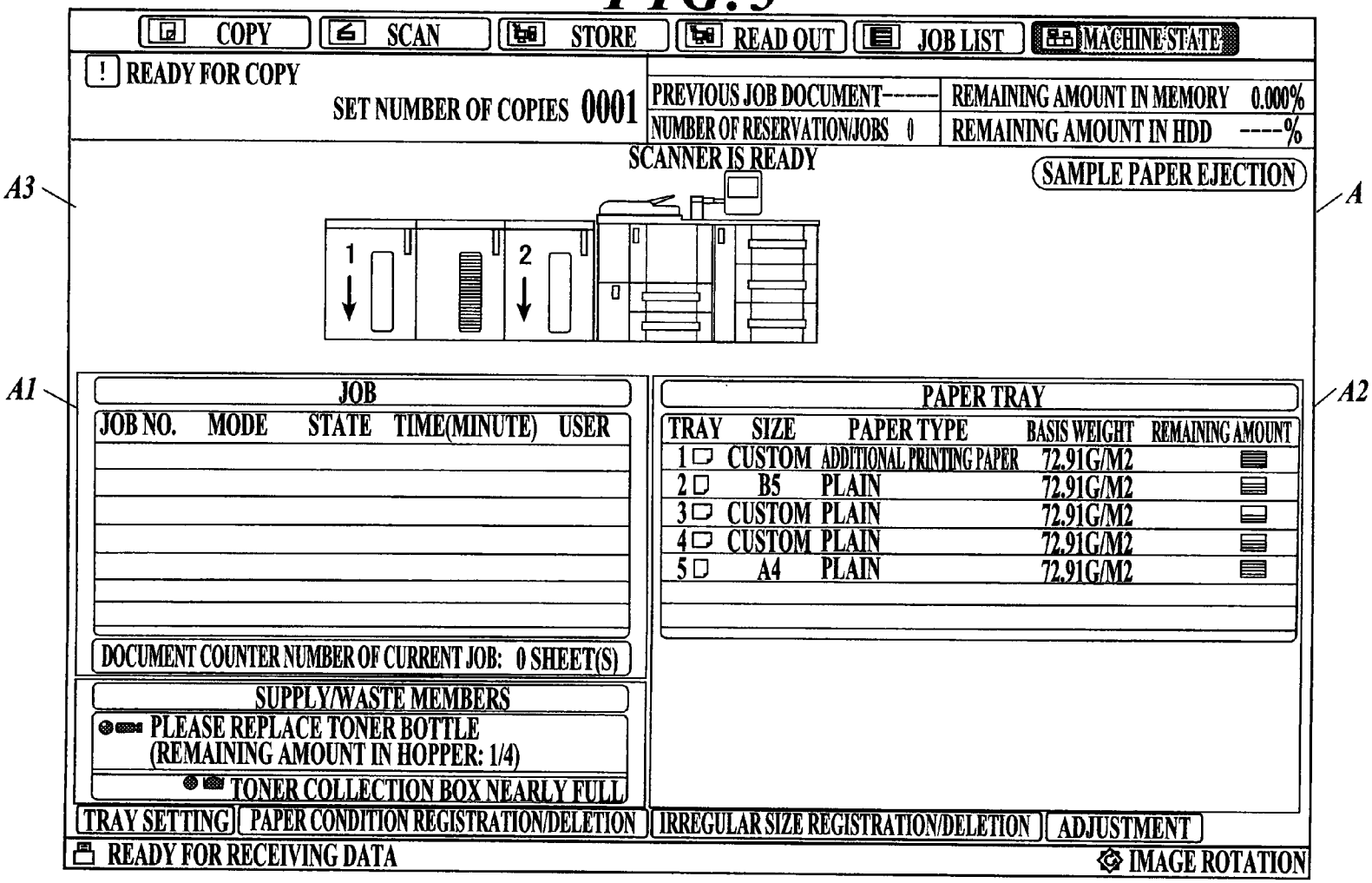
FIG. 5 is a diagram illustrating an example of a display screen.
Figure 6:
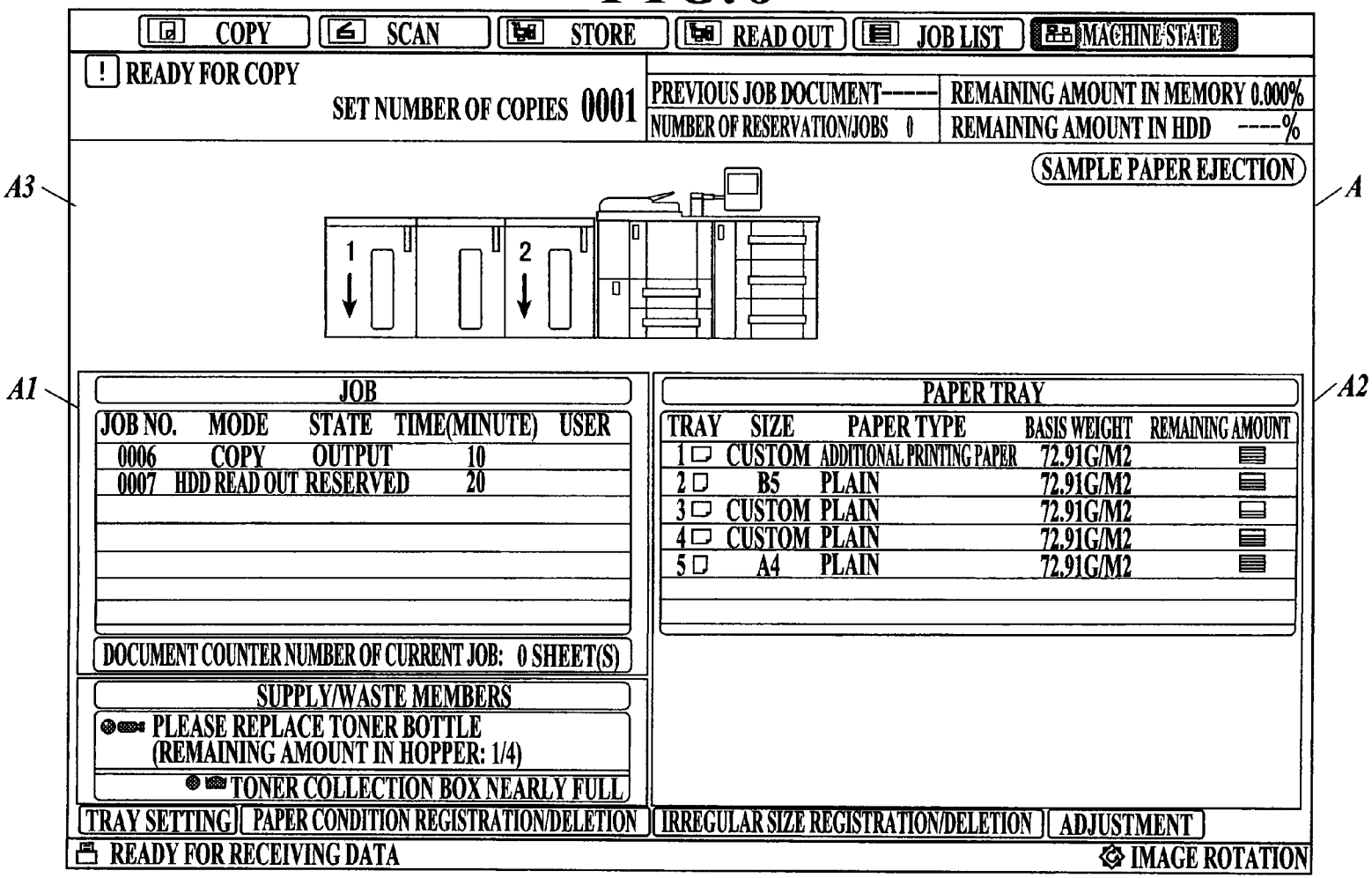
FIG. 6 is a diagram illustrating an example of a display screen.

FIG. 5 is an example of pattern diagram indicating that the second stacker 60B is full. Also, FIG. 6 is an example of pattern diagram indicating that the second stacker 60B is in use (in use for paper ejection). FIGS. 5 and 6 also show that the paper ejection order is determined that the third stacker is first and the first stacker is second.

It is also possible to change the paper ejection order by user's setting change operation after paper ejection order is determined based on the "predetermined paper ejection order".

Here, with reference to FIG. 7, a setting screen G which is displayed on the display unit 301 when a user performs setting change operation to change the priority order (paper ejection order) for using the first stacker 60A, the second stacker 60B and the third stacker 60C will be explained specifically.

A stacker selection area G1 is displayed in the setting screen G and any one of "stacker 1" indicating the first stacker 60A, "stacker 2" indicating the second stacker 60B and "stacker 3" indicating the third stacker 60C is displayed so as to be selectable in the stacker selection area G1, for example.

Also, a paper ejection order change button B1 is displayed in the setting screen G and either "up" or "down" can be operated by the paper ejection order change button B1.

By selecting any one of the stackers in the stacker selection area G1 and operating "up" or "down" by the paper ejection change button B1, the user can change the paper ejection order of the selected stacker.

Figure 7:
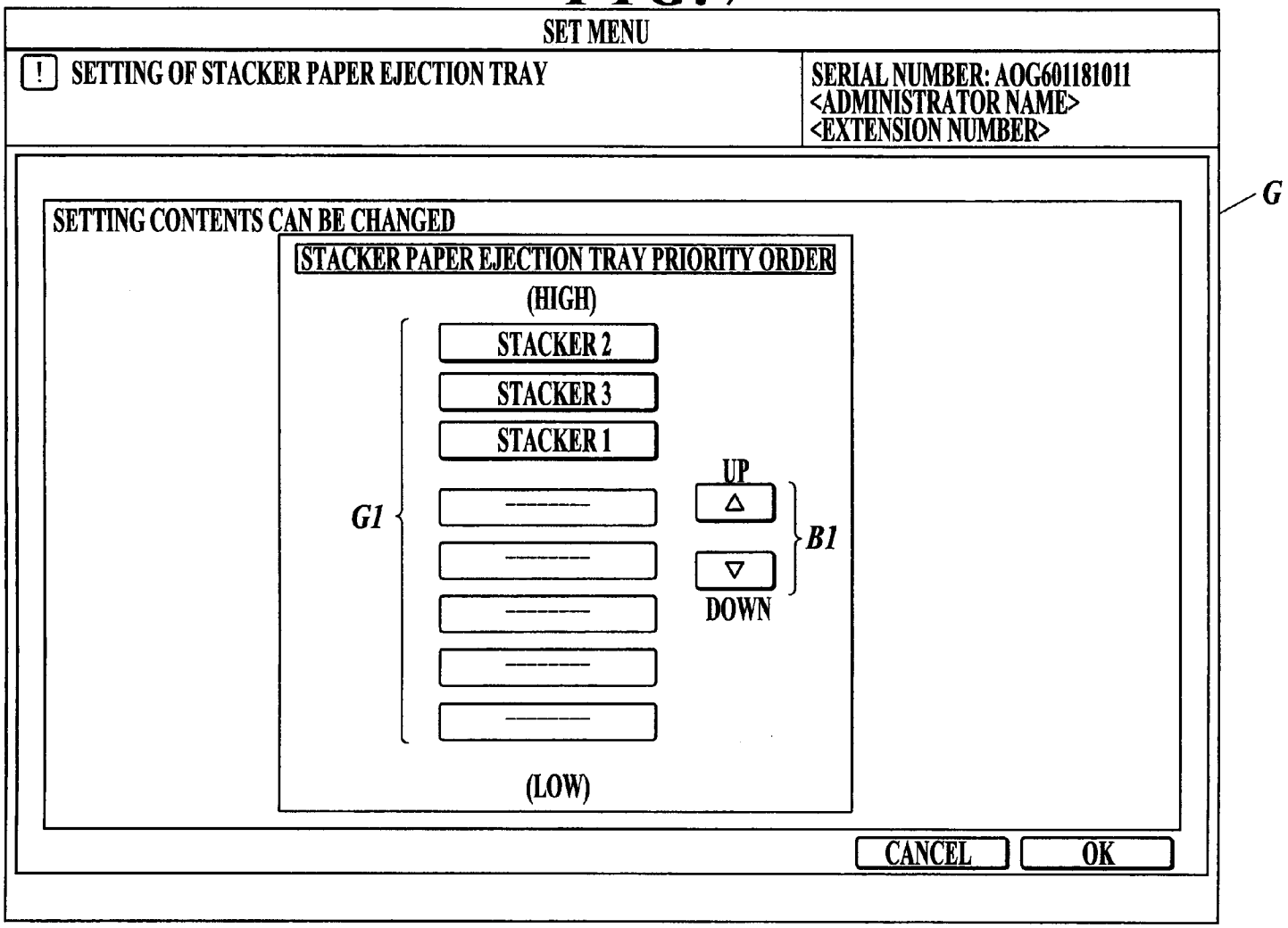
FIG. 7 is a diagram illustrating an example of a setting screen.

FIG. 7 is an example showing that the paper ejection order is set so that "stacker 2" is first, "stacker 3" is second and "stacker 1" is third.

As described above, information regarding paper ejection order (hereinafter, paper ejection order information J2) which was determined by the paper ejection order determination processing or setting change operation by a user is stored in the non-volatile memory 811.

On the other hand, information regarding state of the paper ejection unit 61 in the stacker (hereinafter, state information J1) is stored in the above non-volatile memory 811 or RAM which is not shown in the drawings.

The state information J1 is classified into following five stages;

0: non-set state (state where the conveyance cart 68B is not set in the paper ejection unit 61)

1: set state (state where the conveyance cart 68B is set in the paper ejection unit 61)

2: paper ejecting state (state where sheets of paper are being ejected and the stage 68 is coming down)

3: paper existing state (state where sheets of paper remain on the stopped stage 68)

4: full state (state where the stage 68 is lowered to the lowest level)

The paper ejection order information J2 is classified into following four stages;

0: not specified

1: paper ejection order 1

2: paper ejection order 2

3: paper ejection order 3

The state information J1 and the paper ejection order information J2 are to be rewritten by the above paper ejection order determination processing and such like.

Figure 10:
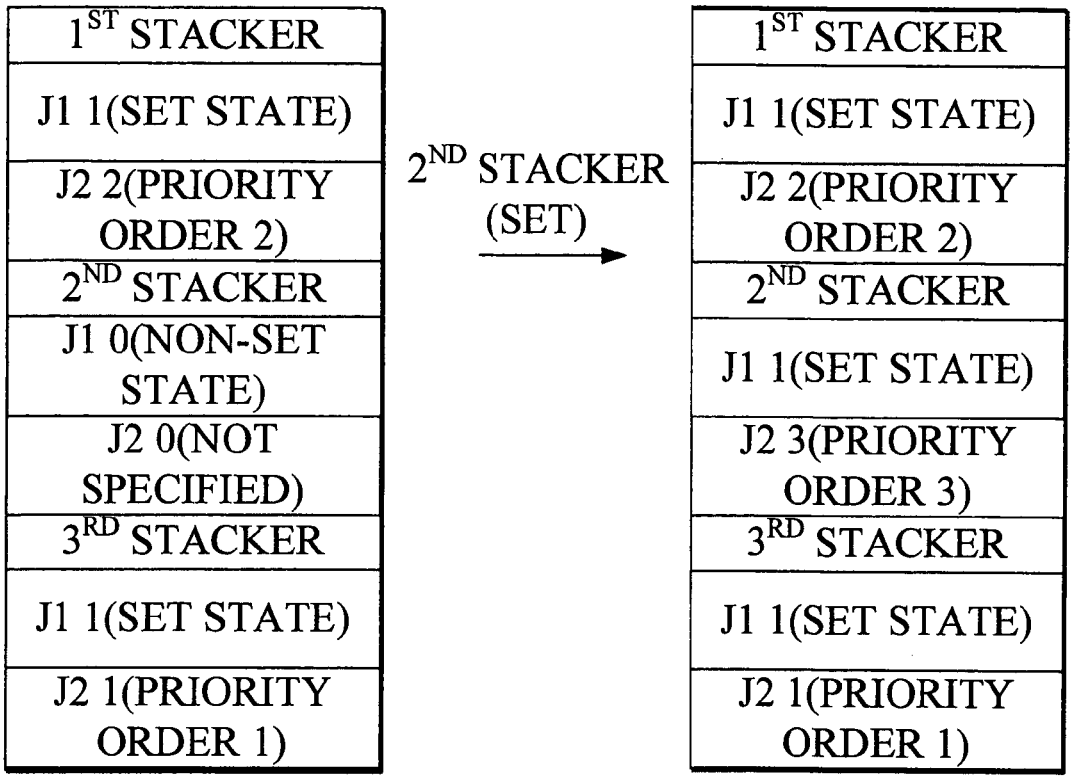
FIG. 10 is a diagram for explaining rewrite of the state information and paper ejection order information.

FIGS. 9 and 10 show an example of rewrite of the state information J1 and the paper ejection order information J2.

FIG. 9 shows the rewrite of the state information J1 and the paper ejection order information J2 when the conveyance cart 68B is removed from the paper ejection unit 61 of a stacker (here, the first stacker 60A).

Before the rewrite, the state information J1 and the paper ejection order information J2 of three stackers 60A, 60B and 60C are as follows;

The first stacker 60A "J1:1 (set state), J2:2 (paper ejection order 2)"

The second stacker 60B "J1:1 (set state), J2:3 (paper ejection order 3)"

The third stacker 60C "J1:1 (set state), J2:1 (paper ejection order 1)"

In this state, when the conveyance cart 68B of the first stacker 60A is removed, the state information J1 and the paper ejection order information J2 of the three stackers are rewritten as follows;

The first stacker 60A "J1:0 (non-set state), J2:0 (not specified)"

The second stacker 60B "J1:1 (set state), J2:2 (paper ejection order 2)"

The third stacker 60C "J1:1 (set state), J2:1 (paper ejection order 1)"

That is, paper ejection order is determined on paper ejection units 61 other than a paper ejection unit 61 in a state where the conveyance cart 68B is removed.

FIG. 10 shows the rewrite of the state information J1 and the paper ejection order information J2 when the conveyance cart 68B is set in the paper ejection unit 61 of a stacker (here, the second stacker 60B).

Before the rewrite, the state information J1 and the paper ejection order information J2 of the three stackers are as follows;

The first stacker 60A "J1:1 (set state), J2:2 (paper ejection order 2)"

The second stacker 60B "J1:0 (non-set state), J2:0 (not specified)"

The third stacker 60C "J1:1 (set state), J2:1 (paper ejection order 1)"

In such state, when the conveyance cart 68B is set in the second stacker 60B, the state information J1 and the paper ejection order information J2 of the three stackers are rewritten as follows;

The first stacker 60A "J1:1(set state), J2:2 (paper ejection order 2)"

The second stacker 60B "J1:1(set state), J2:3 (paper ejection order 3)"

The third stacker 60C "J1:1(set state), J2:1 (paper ejection order 1)"

That is, paper ejection order is determined to be the order in which the conveyance carts 68B are set in respective paper ejection units 61.

Next, operations of the image forming apparatus 1 in the embodiment will be explained with reference to FIGS. 11 to 16.

Each of the following processing is performed by the control unit 809 of the image processing unit 80 in cooperation with the input control unit 303 of the display operation unit 30, the printer control unit 402 of the printer unit 40, the stacker control units 607 of the paper ejection mechanisms 60 and such like.

[Paper Ejection Order Determination Processing]

Figure 11:
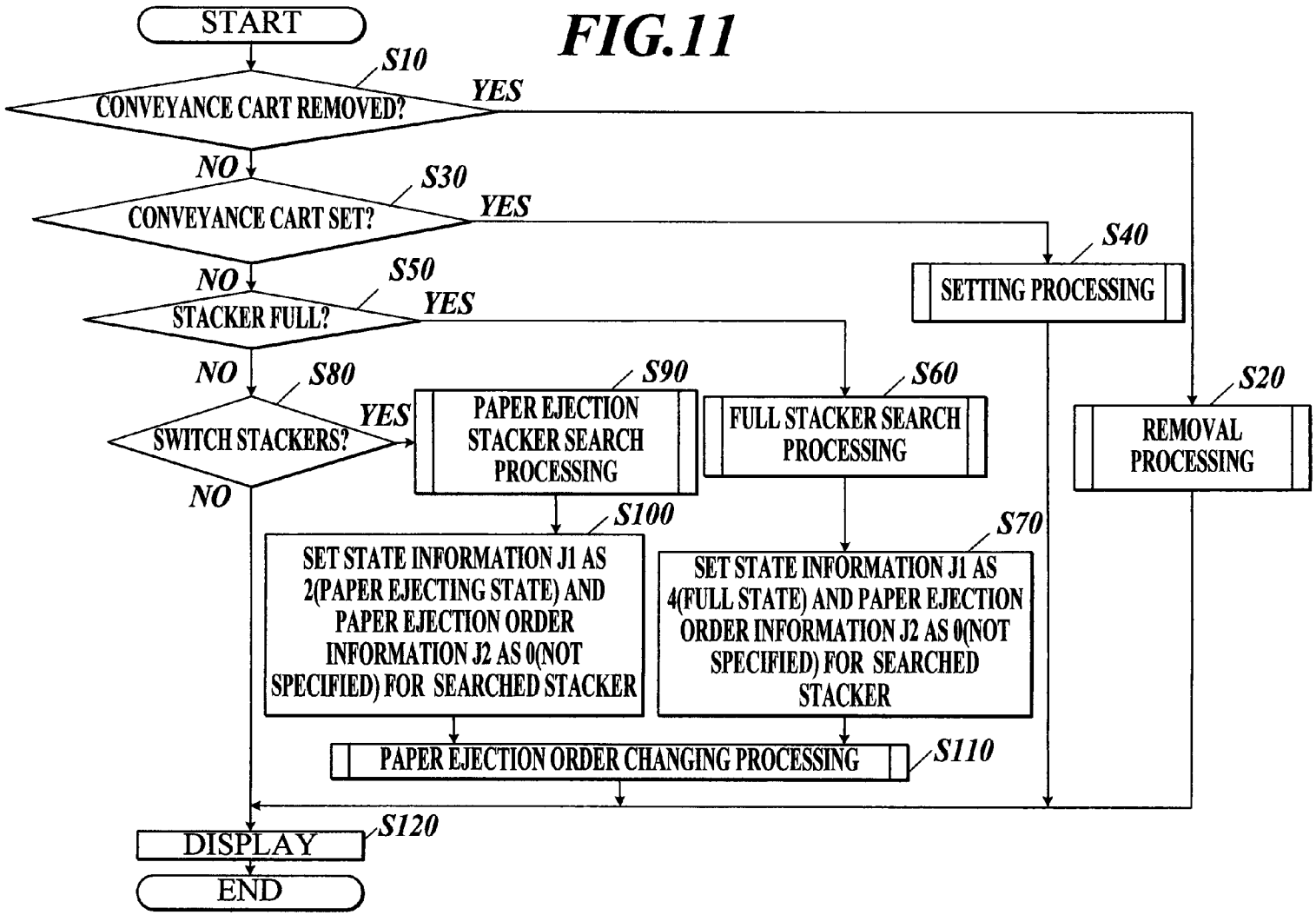
FIG. 11 is a flowchart showing paper ejection order determination processing.

FIG. 11 is a flowchart showing processing procedure of the paper ejection order determination processing.

First, in step S10, the control unit 809 judges whether the conveyance cart 68B is removed in any one of the first stacker 60A, the second stacker 60B and the third stacker 60C. If it is judged that the conveyance cart 68B is removed (step S10: YES), the control unit 809 performs removal processing (see FIG. 12) which is performed when the conveyance cart 68B is removed in the following step S20, and shifts to after-mentioned step S120.

On the other hand, in the above step S10, if the conveyance cart 68B is not removed (step S10: NO), the control unit 809 judges whether the conveyance cart 68B is set in any one of the first stacker 60A, the second stacker 60B and the third stacker 60C in the following step S30. If it is judged that the conveyance cart 68B is set (step S30: YES), the control unit 809 performs setting processing (see FIG. 13) which is performed when the conveyance cart 68B is set in the following step S40, and shifts to step S120 mentioned below.

On the other hand, in the above step S30, if it is judged that the conveyance cart 68B is not set (step S30: NO), the control unit 809 judges whether the paper ejection unit 61 is full in any one of the first stacker 60A, the second stacker 60B and the third stacker 60C in the following step S50. If it is judged that a paper ejection unit 61 is full (step S50: YES), the control unit 809 performs full stacker search processing (see FIG. 14) which searches the full stacker among the first stacker 60A, the second stacker 60B and the third stacker 60C in the following step S60, and shifts to step S70 mentioned below.

Next, in step S70, the control unit 809 sets the state information J1 stored in the non-volatile memory 811 as 4 (full state) and the paper ejection order information J2 as 0 (not specified) with respect to the stacker (stacker in which the full stacker information mentioned below is set) detected as the full stacker in the above step S60, and shifts to step S110 mentioned below.

On the other hand, in the above step S50, if the control unit 809 judges that the stackers are not full (step S50: NO), the control unit 809 judges whether it is the timing to switch the stackers in the following step S80. If the control unit 809 judges that it is the timing to switch the stacker (step S80: YES), the control unit 809 performs paper ejection stacker search processing (see FIG. 15) which searches a stacker to be switched to among the first stacker 60A, the second stacker 60B and the third stacker 60C in the following step S90, and shifts to step S100 mentioned below.

Next, in step S100, the control unit 809 sets the state information J1 stored in the non-volatile memory 811 as 2 (paper ejecting state) and the paper ejection order information J2 as 0 (not specified) with respect to the stacker (the stacker in which the paper ejection stacker information mentioned below is set) which is detected as a stacker to be switched to in the above step S90, and shifts to step S110 mentioned below.

Next, in step S110, the control unit 809 performs paper ejection order changing processing (see FIG. 16) which changes the paper ejection order of the first stacker 60A, the second stacker 60B and the third stacker 60C.

On the other hand, in the above step S80, if the control unit 809 does not judge that the stacker is to be switched (step S80: NO), the control unit 809 displays the paper ejection order and the state of each stacker on the display unit 301 based on the state information J1 and paper ejection order information J2 stored in the non-volatile memory 811 in the following step S120, and ends the processing.

[Removal Processing]

Figure 12:
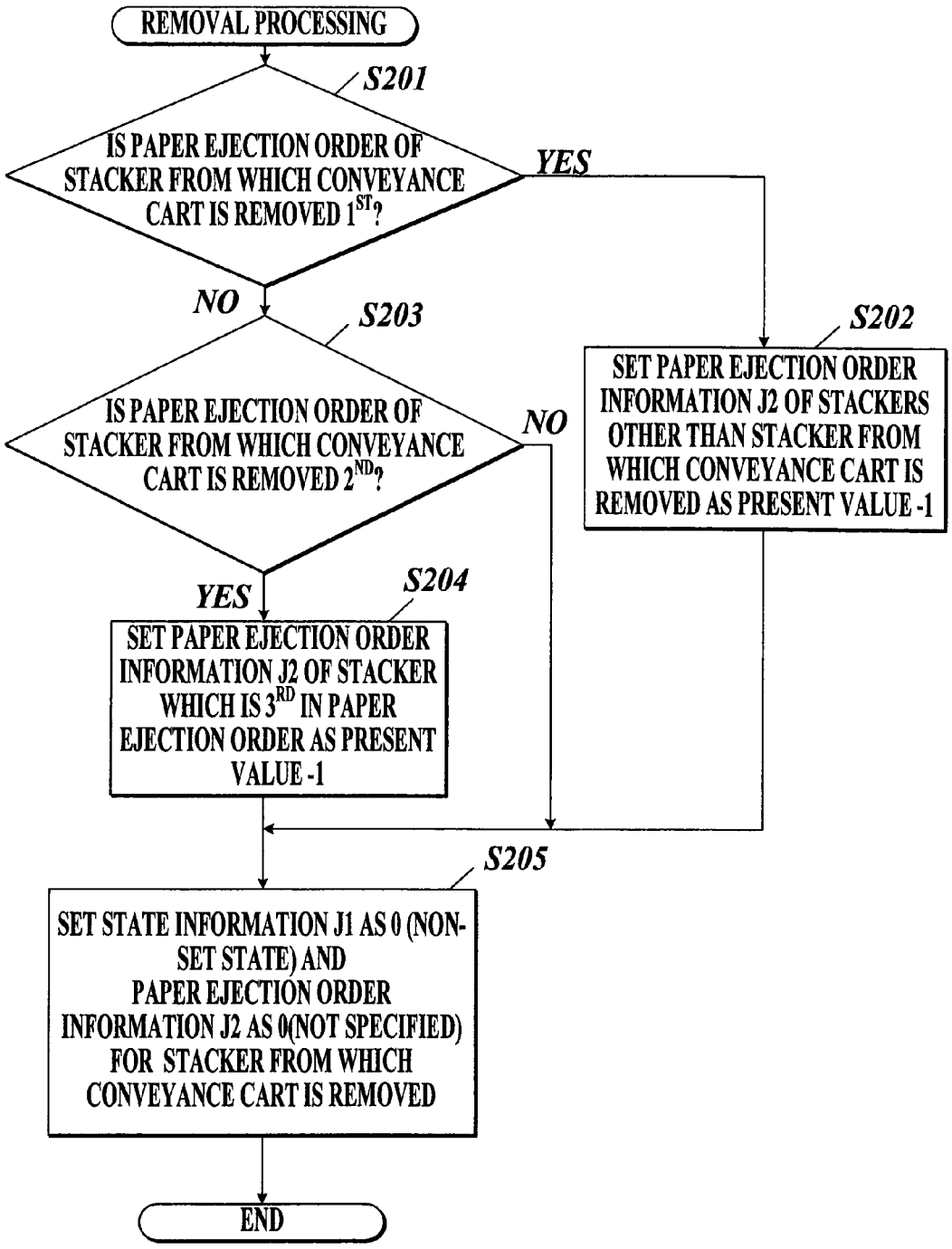
FIG. 12 is a flowchart showing removal processing.

FIG. 12 is a flowchart showing processing procedure of removal processing in step S20 of FIG. 11.

First, in step S201, the control unit 809 refers to the non-volatile memory 811 and judges whether the paper ejection order of the stacker from which the conveyance cart 68B is removed is first. If the paper ejection order is first (step S201: YES), in the following step S202, the control unit 809 sets the paper ejection order information J2 as the present value −1 with respect to the stackers other than the stacker from which the conveyance cart 68B is removed. That is, the paper ejection order is raised by one in each of the stackers other than the stacker from which the conveyance cart 68B is removed.

On the other hand, if the paper ejection order of the stacker from which the conveyance cart 68B is removed is not first (step S201: NO), the control unit 809 judges whether paper ejection order of the stacker from which the conveyance cart 68B is removed is second in the following step S203. If the paper ejection order is not second (step S203: NO), the control unit 809 shifts to step S205 described later.

On the other hand, if the paper ejection order of the stacker from which the conveyance cart 68B is removed is second (step S203: YES), the control unit 809 sets the paper ejection order information J2 of the stacker which is third in the paper ejection order (the stacker in which the paper ejection order information J2 is set as 3) as present value −1 in the following step S204. That is, the paper ejection order of the stacker which is third in the paper ejection order is raised by one.

Next, in step S205, the control unit 809 sets the state information J1 as 0 (non-set state) and paper ejection order information J2 as 0 (not specified) with respect to the stacker from which the conveyance cart 68B is removed, and ends the processing.

[Setting Processing]

Figure 13:
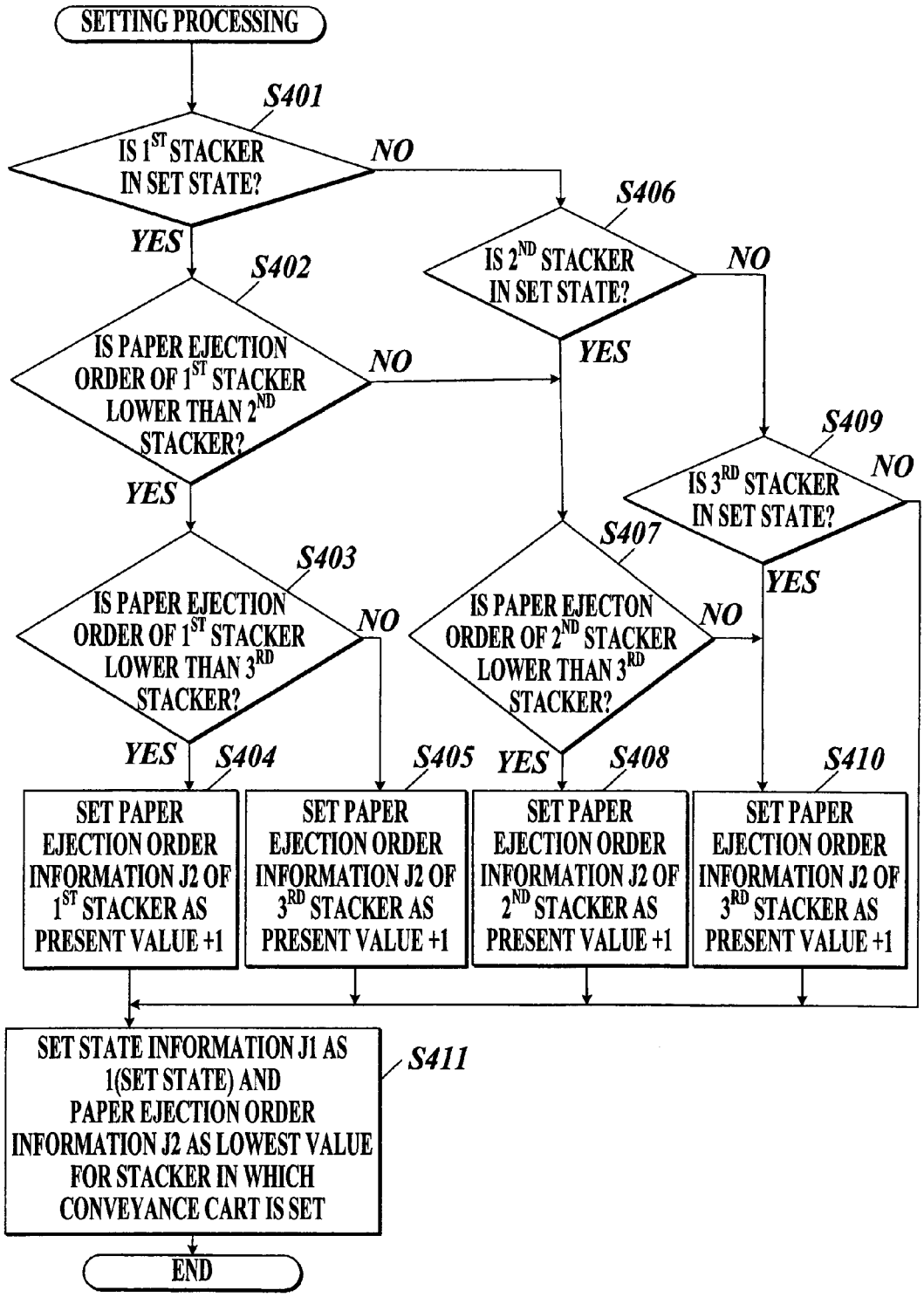
FIG. 13 is a flowchart showing setting processing.

FIG. 13 is a flowchart showing processing procedure of setting processing in step S40 of FIG. 11.

First, in step S401, the control unit 809 refers to the non-volatile memory 811 and judges whether the first stacker 60A is in a set state. If the first stacker 60A is in the set state (step S401: YES), the control unit 809 judges whether the paper ejection order of the first stacker 60A is lower than the paper ejection order of the second stacker 60B in the following step S402. If the paper ejection order of the first stacker 60A is not lower than the paper ejection order of the second stacker 60B (step S402: NO), the control unit 809 shifts to step S407 mentioned below.

On the other hand, if the paper ejection order of the first stacker 60A is lower than the paper ejection order of the second stacker 60B (step S402: YES), the control unit 809 judges whether the paper ejection order of the first stacker 60A is lower than the paper ejection order of the third stacker 60C in following step S403. If the paper ejection order of the first stacker 60A is lower than the paper ejection order of the third stacker 60C (step S403: YES), the control unit 809 sets the paper ejection order information J2 of the first stacker 60A as present value +1 in the following step S404, and shifts to step S411 mentioned below.

On the other hand, if the paper ejection order of the first stacker 60A is not lower than the paper ejection order of the third stacker 60C (step S403: NO), the control unit 809 sets the paper ejection order information J2 of the third stacker 60C as present value +1 in the following step S405, and shifts to step S411 mentioned below.

Also in the above step S401, if the first stacker 60A is not in a set state (step S401: NO), the control unit 809 judges whether the second stacker 60B is in a set state in the following step S406. If the second stacker 60B is in a set state (step S406: YES), the control unit 809 judges whether the paper ejection order of the second stacker 60B is lower than the paper ejection order of the third stacker 60C in the following step S407.

Then, if the paper ejection order of the second stacker 60B is not lower than the paper ejection order of the third stacker 60C (step S407: NO), the control unit 809 shifts to step S410 mentioned below. On the other hand, if the paper ejection order of the second stacker 60B is lower than the paper ejection order of the third stacker 60C (step S407: YES), the control unit 809 sets the paper ejection order information J2 of the second stacker 60B as present value +1 in the following step S408, and shifts to step S411 mentioned below.

Also, in the above step S406, if the second stacker 60B is not in a set state (step S406: NO), the control unit 809 judges whether the third stacker 60C is in a set state in the following step S409. If the third stacker 60C is not in a set state (step S409: NO), the control unit 809 shifts to step S411 mentioned below.

On the other hand, if the third stacker 60C is in a set state (step S409: YES), the control unit 809 sets the paper ejection order information J2 of the third stacker 60C as present value +1 in the following step S410, and shifts to step S411 mentioned below.

Next, the control unit 809 sets the state information J1 of the stacker in which a conveyance cart 68B is newly set as 1 (set state) and the paper ejection order information J2 to be the lowest paper ejection order in step S411, and ends the processing.

[Full Stacker Search Processing]

Figure 14:
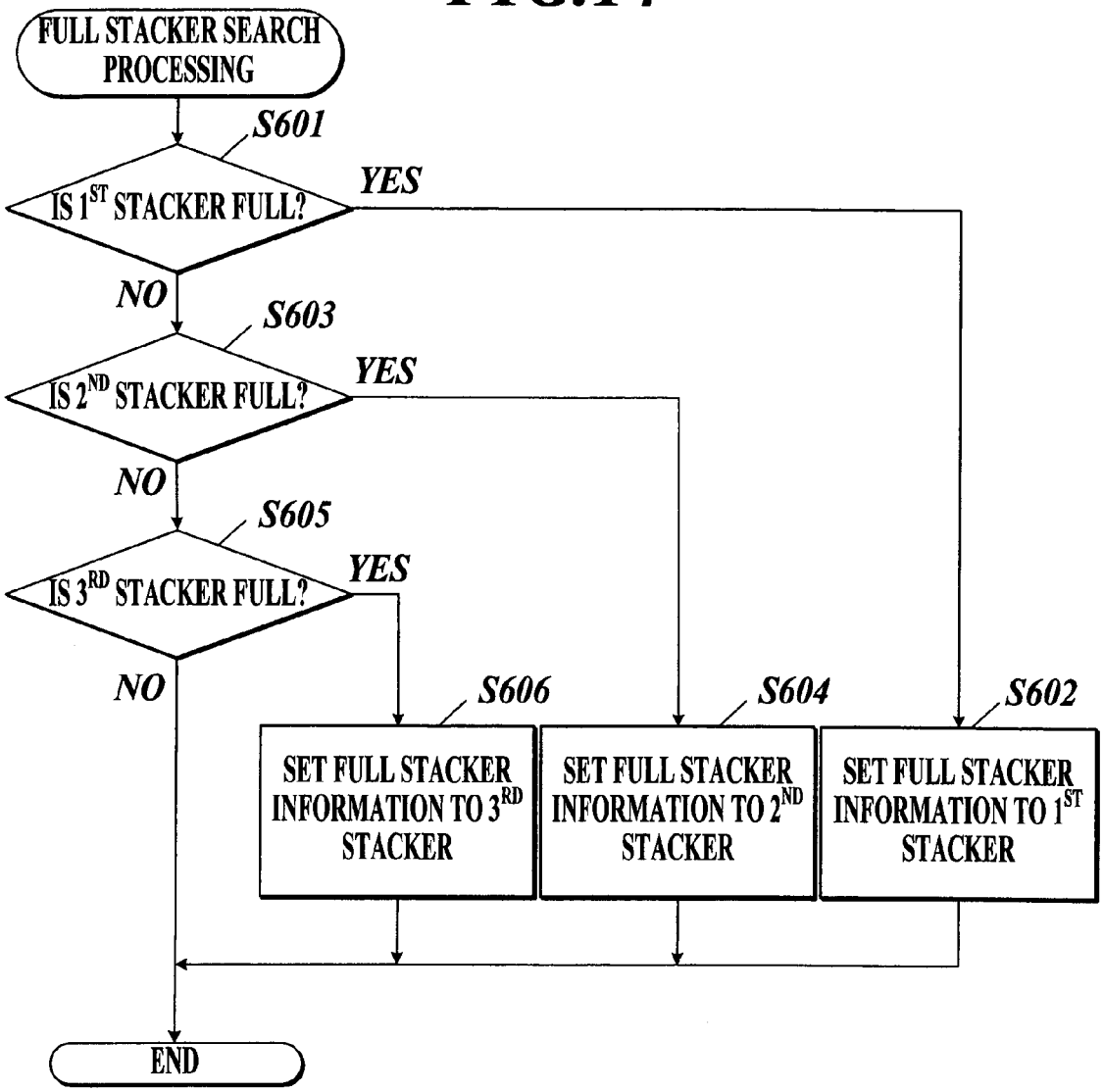
FIG. 14 is a flowchart showing full stacker search processing.

FIG. 14 is a flowchart showing processing procedure of full stacker search processing in step S60 of FIG. 11.

First, in step S601, the control unit 809 judges whether the first stacker 60A is full based on the sheet upper limit sensor 603 of the first stacker 60A. If the first stacker is judged to be full (step S601: YES), the control unit 809 sets a flag indicating that the stacker is full (full stacker information) in the first stacker 60A in the following step S602, and ends the processing.

On the other hand, if the first stacker 60A is not judged to be full (step S601: NO), in the following step S603, the control unit 809 judges whether the second stacker 60B is full based on the sheet upper limit sensor 603 of the second stacker 60B. If the second stacker 60B is judged to be full (step S603: YES), the control unit 809 sets the full stacker information in the second stacker 60B in the following step S604, and ends the processing.

On the other hand, if the second stacker 60B is not judged to be full (step S603: NO), in the following step S605, the control unit 809 judges whether the third stacker 60C is full based on the sheet upper limit sensor 603 of the third stacker 60C. If the third stacker 60C is not judged to be full (step S605: NO), the control unit 809 ends the processing.

On the other hand, if the third stacker 60C is judged to be full (step S605: YES), the control unit 809 sets the full stacker information in the third stacker 60C in the following step S606, and ends the processing.

[Paper Ejection Stacker Search Processing]

Figure 15:
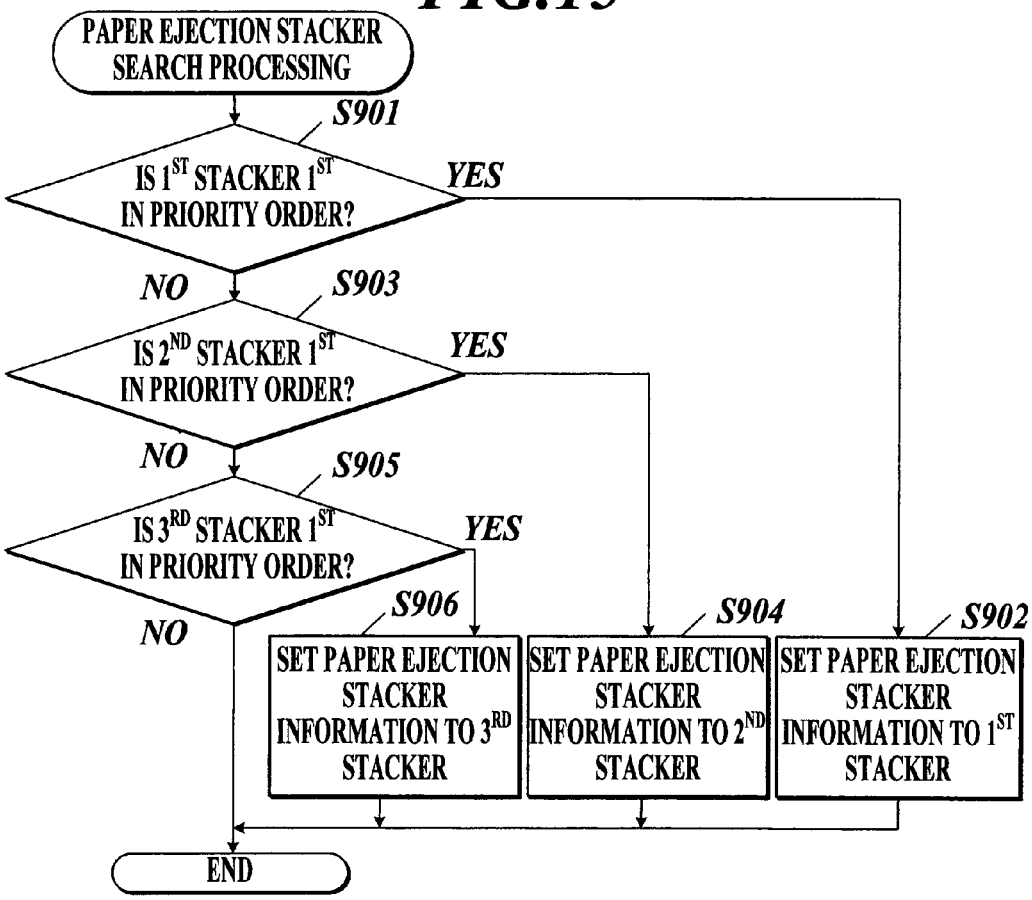
FIG. 15 is a flowchart showing paper ejection stacker search processing.

FIG. 15 is a flowchart showing processing procedure of paper ejection stacker search processing in step S90 of FIG. 11.

First, in step S901, the control unit 809 refers to the non-volatile memory 811 and judges whether the paper ejection order of the first stacker 60A is first. If the paper ejection order of the first stacker 60A is judged to be first (step S901: YES), the control unit 809 sets a flag (paper ejection stacker information) indicating that sheets of paper are being ejected to the first stacker 60A in the following step S902, and ends the processing.

If the paper ejection order of the first stacker 60A is not judged to be first (step S901: NO), the control unit 809 judges whether the paper ejection order of the second stacker 60B is first in the following step S903.

Then, if the paper ejection order of the second stacker 60B is judged to be first (step S903: YES), the control unit 809 sets paper ejection stacker information in the second stacker 60B in the following step S904, and ends the processing.

On the other hand, if the paper ejection order of the second stacker 60B is not judged to be first (step S903: NO), the control unit 809 judges whether the paper ejection order of the third stacker 60C is first in the following step S905. If the paper ejection order of the third stacker 60C is not first (step S905: NO), the control unit 809 ends the processing.

On the other hand, if the paper ejection order of the third stacker 60C is first (step S905: YES), the control unit 809 sets the paper ejection stacker information in the third stacker 60C in the following step S906 and ends the processing.

[Paper Ejection Order Changing Processing]

Figure 16:
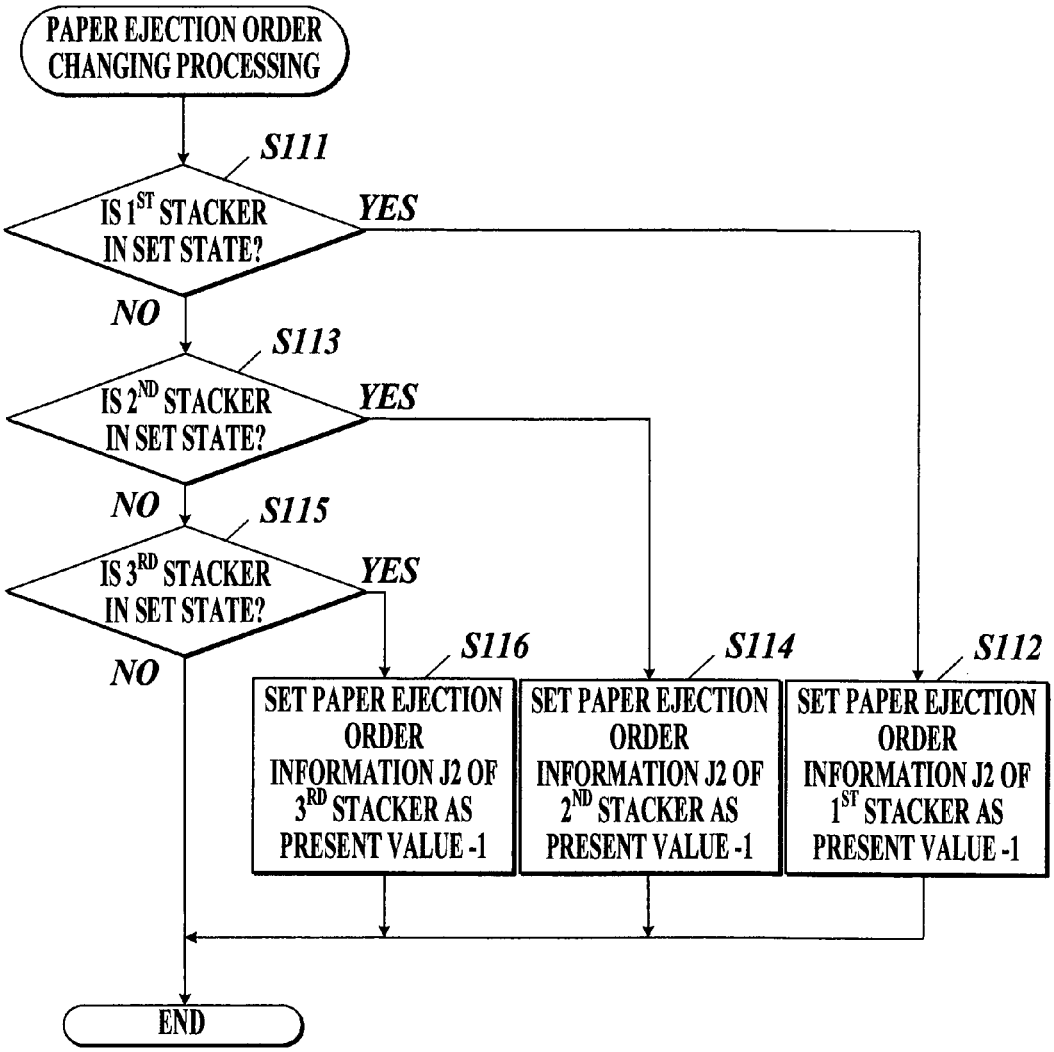
FIG. 16 is a flowchart showing paper ejection order changing processing.

FIG. 16 is a flowchart showing processing procedure of paper ejection order changing processing in step S110 of FIG. 11.

First, in step S111, the control unit 809 refers to the non-volatile memory 811 and judges whether the first stacker 60A is in a set state. If the first stacker 60A is in a set state (step S111: YES), the control unit 809 sets the paper ejection information J2 of the first stacker 60A as present value −1 in the following step S112 and ends the processing.

On the other hand, if the first stacker 60A is not in a set state (step S111: NO), the control unit 809 judges whether the second stacker 60B is in a set state in the following step S113. If the second stacker 60B is in a set state (step S113: YES), the control unit 809 sets paper ejection order information J2 of the second stacker 60B as present value −1 in the following step S114 and ends the processing.

On the other hand, if the second stacker 60B is not in a set state (step S113: NO), the control unit 809 judges whether the third stacker 60C is in a set state in the following step S115. If the third stacker 60C is not in a set state (step S115: NO), the control unit 809 ends the processing.

On the other hand, if the third stacker 60C is in a set state (step S115: YES), the control unit 809 sets the paper ejection information J2 of the third stacker 60C as present value −1 in the following step S116 and ends the processing.

As described above, according to the image forming apparatus 1 in the embodiment, paper ejection order is determined for the stackers to which sheets can be ejected among the three stackers 60A, 60B and 60C by a predetermined order.

Therefore, a stacker to which sheets of paper are to be ejected next can be recognized easily.

In addition, according to the image forming apparatus 1 in the embodiment, the stackers to which sheets can be ejected are stackers other than a stacker in a state where the conveyance cart 68B is removed.

Thus, paper ejection order can be determined effectively because paper ejection order of the stackers is determined by excluding a stacker in a state where the conveyance cart 68B is removed.

In addition, according to the image forming apparatus 1 in the embodiment, the stackers to which sheets can be ejected are stackers other than a stacker in a full state where the sheets are fully loaded on the loading unit 68.

Thus, paper ejection order can be effectively determined because paper ejection order of the stackers is determined by excluding a stacker in a full state where the sheets are fully loaded on the loading unit 68.

In addition, according to the image forming apparatus 1 in the embodiment, the predetermined order is the order in which the conveyance carts 68B are set.

Therefore, paper ejection order is determined to be the order in which a user sets conveyance carts 68B by himself/herself, and thereby the stacker to which sheets of paper are to be ejected next can be recognized easily by the user, which can improve work efficiency of when the conveyance cart 68B is removed, and such like.

In addition, according to the image forming apparatus 1 in the embodiment, the control unit determines the paper ejection order by an order based on the setting change operation when a user performs the setting change operation to set the paper ejection order.

Therefore, paper ejection order is determined to be the order which is set by a user arbitrarily, and thereby the stacker to which sheets of paper are to be ejected next can be recognized easily by a user, which can improve work efficiency of when the conveyance cart 68B is removed, and such like.

In addition, according to the image forming apparatus 1 in the embodiment, the display unit 301 which displays the paper ejection order is provided.

Therefore, the stacker to which sheets of paper are to be ejected next can be recognized more easily and work efficiency can be improved.

In addition, according to the image forming apparatus 1 in the embodiment, the display unit 301 can display which state of "full", "ejecting paper" and "ready for paper ejection" each of the stackers is in (each paper ejection unit 61).

Therefore, a user can recognize the state of each stacker plainly and work efficiency can be improved more.

In addition, according to the image forming apparatus 1 in the embodiment, immediately after the image forming apparatus is turned on, paper ejection order of the stackers is determined to be the ascending order of distance from the image forming unit, wherein a stacker in a state where the conveyance cart 68B is removed and a stacker in a full state where the sheets are fully loaded on the stage 68 are excluded.

Therefore, the most appropriate paper ejection order is determined immediately after the apparatus is turned on.

Although the configuration including three stackers (first stacker 60A, second stacker 60B and third stacker 60C) is explained as an example in the above embodiment, the present invention shall not be limited to this as long as the apparatus includes three or more stackers.

According to one aspect of the preferred embodiments of the present invention, there is provided an image forming apparatus including an image forming unit which continuously forms an image on sheets of paper, three or more stackers to which the sheets on which the image is formed by the image forming unit are ejected and a control unit which determines paper ejection order of stackers to which the sheets are to be ejected among the three or more stackers in a predetermined order, wherein each of the stackers includes a loading unit on which the sheets are loaded and a conveyance cart which is disposed under the loading unit and by which the loading unit can be removed from the stacker.

According to the embodiment, paper ejection order is determined for stackers to which sheets can be ejected among the three or more stackers by a predetermined order.

Therefore, the stacker to which sheets of paper are to be ejected next can be recognized more easily.

According to one aspect of the preferred embodiments of the present invention, the stackers to which the sheets are to be ejected are stackers other than a stacker in a state where the conveyance cart is removed.

According to the embodiment, paper ejection order can be determined effectively because paper ejection order of the stackers is determined by excluding a stacker in a state where the conveyance cart is removed.

According to one aspect of the preferred embodiments of the present invention, the stackers to which the sheets are to be ejected are stackers other than a stacker in a full state where the sheets are fully loaded on the loading unit.

According to the embodiment, paper ejection order can be effectively determined because paper ejection order of the stackers is determined by excluding a stacker in a full state where the sheets are fully loaded on the loading unit.

According to one aspect of the preferred embodiments of the present invention, the predetermined order is an order in which the conveyance carts are set.

According to the embodiment, paper ejection order is determined to be the order in which a user sets conveyance carts by himself/herself, and thereby the stacker to which sheets of paper are to be ejected next can be recognized easily by the user, which can improve work efficiency of when the conveyance cart is removed, and such like.

According to one aspect of the preferred embodiments of the present invention, the control unit determines the paper ejection order in an order based on setting change operation when a user performs the setting change operation to set the paper ejection order.

According to the embodiment, paper ejection order is determined to be the order which is set by a user arbitrarily, and thereby the stacker to which sheets of paper are to be ejected next can be recognized easily by a user, which can improve work efficiency of when the conveyance cart is removed, and such like.

According to one aspect of the preferred embodiments of the present invention, a display unit which displays the paper ejection order is provided.

According to the embodiment, the stacker to which sheets of paper are to be ejected next can be recognized more easily and work efficiency can be improved.

According to one aspect of the preferred embodiments of the present invention, the display unit displays which state among "full", "ejecting paper" and "ready for paper ejection" each of the stackers is in.

According to the embodiment, the user can recognize the state of each stacker plainly and work efficiency can be improved more.

According to one aspect of the preferred embodiments of the present invention, the control unit determines the paper ejection order of the stackers to be an ascending order of distance from the image forming unit immediately after the image forming apparatus is turned on, a stacker in a state where the conveyance cart is removed and a stacker in a full state where the sheets are fully loaded on the loading unit being excluded.

According to the embodiment, the most appropriate paper ejection order is determined immediately after the apparatus is turned on.

The entire disclosure of Japanese Patent Application No. 2011-202716 filed on Sep. 16, 2011 including description, claims, drawings, and abstract are incorporated herein by reference in its entirety.

What is claimed is:

1. An image forming apparatus, comprising:

an image forming unit which continuously forms an image on sheets of paper, at least three stackers to which the sheets on which the image is formed by the image forming unit are ejected, and a control unit which determines a paper ejection order of stackers to which the sheets are to be ejected among the at least three stackers in a predetermined order, wherein each of the stackers comprises:

a loading unit on which the sheets are loaded, and a conveyance cart which is disposed under the loading unit and by which the loading unit can be removed from the stacker; and wherein the predetermined order is an order in which the conveyance carts are set.

2. The image forming apparatus according to claim 1, wherein the stackers to which the sheets are to be ejected are stackers other than a stacker in a state in which the conveyance cart thereof is removed.

3. The image forming apparatus according to claim 1, wherein the stackers to which the sheets are to be ejected are stackers other than a stacker in a full state in which the sheets are fully loaded on the loading unit thereof.

4. The image forming apparatus according to claim 1, wherein the control unit determines the paper ejection order based on a setting change operation when a user performs the setting change operation to set the paper ejection order.

5. The image forming apparatus according to claim 1, further comprising a display unit which displays the paper ejection order.

6. The image forming apparatus according to claim 5, wherein the display unit displays an operation state for each of the stackers, said operation state being one of a full state, an ejecting paper state and a ready state for paper ejection.

7. An image forming apparatus comprising:

an image forming unit which continuously forma an image on sheets of paper, at least three stackers to which the sheets on which the image is formed by the image forming unit are ejected; and a control unit which determines a paper ejection order of stackers to which the sheets are to be ejected among the at least three stackers in a predetermined order;

wherein each of the stackers comprises:

a loading unit on which the sheets are loaded, and a conveyance cart which is disposed under the loading unit and by which the loading unit can be removed from the stacker; and wherein the control unit determines the paper ejection order of the stackers to be an ascending order of distance from the image forming unit immediately after the image forming apparatus is turned on, except that a stacker in a state in which the conveyance cart thereof is removed and a stacker in a full state in which the sheets are fully loaded on the loading unit thereof are excluded.

8. The image forming apparatus according to claim 7, wherein the stackers to which the sheets are to be ejected are stackers other than a stacker in a state in which the conveyance cart thereof is removed.

9. The image forming apparatus according to claim 7, wherein the stackers to which the sheets are to be ejected are stackers other than a stacker in a full state in which the sheets are fully loaded on the loading unit thereof.

10. The image forming apparatus according to claim 7, wherein the control unit determines the paper ejection order based on a setting change operation when a user performs the setting change operation to set the paper ejection order.

11. The image forming apparatus according to claim 7, further comprising a display unit which displays the paper ejection order.

12. The image forming apparatus according to claim 7, wherein the display unit displays an operation state for each of the stackers, said operation state being one of a full state, an ejecting paper state, and a ready state for paper ejection.

* * * * *